United States Patent [19]

Hanson et al.

[11] 4,154,367

[45] May 15, 1979

[54] COMPOSITE CONTAINER FOR PRESSURIZED SUBSTANCES AND SUPPLY CONTAINER THEREFOR

[76] Inventors: Donald S. Hanson, 9330-46th Ave. N., Minneapolis, Minn. 55428; Harold K. Leyse, 3820 Deerwood La., Minneapolis, Minn. 55441

[21] Appl. No.: 951,577

[22] Filed: Oct. 16, 1978

Related U.S. Application Data

[63] Continuation-in-part of Ser. No. 810,953, Jun. 29, 1977, abandoned.

[51] Int. Cl.[2] ..... B67D 5/54; B67D 5/64

[52] U.S. Cl. ..... 222/130; 220/20; 220/23.86; 222/401; 403/349

[58] Field of Search ..... 220/20, 23.83, 23.86; 222/130, 192, 401, 402, 143; 403/349, 348

[56] References Cited

U.S. PATENT DOCUMENTS

| | | | |
|---|---|---|---|
| 338,832 | 3/1886 | Dinsmore | 222/130 X |
| 1,189,932 | 7/1916 | Garber | 222/402 |
| 1,950,714 | 3/1934 | D'Aoust et al. | 222/130 |
| 2,156,844 | 5/1939 | Gautier | 222/20 |
| 2,527,256 | 10/1950 | Jackson | 403/349 X |
| 3,496,349 | 2/1970 | Townsend | 220/23.86 |
| 4,078,701 | 3/1978 | Clubb | 222/130 |

*Primary Examiner*—David A. Scherbel
*Attorney, Agent, or Firm*—Robert C. Baker; James V. Harmon

[57] ABSTRACT

A dual-compartmented easily separated composite container is provided having a first chamber or tank containing a pressurized substance such as a sanitizing or insecticidal material and another chamber for supplies mounted below the first and supporting it. The top of the supply chamber is sealed by the lower end of the tank. The invention also provides a supply chamber suited for attachment to existing pressurized containers.

5 Claims, 8 Drawing Figures

COMPOSITE CONTAINER FOR PRESSURIZED SUBSTANCES AND SUPPLY CONTAINER THEREFOR

CROSS-REFERENCE TO RELATED APPLICATIONS

This application is a continuation in-part of Ser. No. 810,953 filed June 29, 1977 now abandoned.

FIELD OF THE INVENTION

The invention relates to pressurized containers for liquids, sprays and the like such as pesticides and to a container to be attached thereto to provide a multi-compartmented composite container.

THE PRIOR ART

Sanitizing and pest control technicians and others that use pressurized spray tanks are often inconvenienced by having to carry supplies such as tools, poisons, etc. in their pockets or in the alternative to make several trips back and forth to their truck or other storage facility to bring all of the equipment and supplies needed to the job site. In addition to the inconvenience, it can be dangerous since there is a possibility of leakage or other loss of poisonous substances or accessability to poisons by children.

OBJECTS

The major object of the invention is to provide a container, receptacle or chamber to be attached to a pressurized dispensing container to provide a composite multi-compartmented container having the following characteristics and advantages: (a) it is easily carried, (b) it is safe to use because it remains with the pest control technician, exterminator or other operator at all times: (c) it has provision for completely sealing the auxiliary supply container so that any poisonous substance contained therein are inexcessable to children or others: (d) the auxiliary container is easily separated from the pressurized container, (e) the composite container enables the technician to carry all supplies to a job site as a single unit, (f) the auxiliary supply container is adapted to be secured to the pressurized container without welding or drilling holes in the pressurized container which if required could cause leakage, (g) the auxiliary container is suited for attachment to existing pressurized containers now in use.

In the accomplishment of the foregoing and related advantages and objectives, this invention then comprises the features hereinafter fully described and particularly pointed out in the claims, the following description setting forth in detail certain illustrative embodiments of the invention by way of example these being indicative, however, of but a few of the various ways in which the principles of the invention may be employed.

THE FIGURES

SUMMARY OF THE INVENTION

In accordance with the present invention a container or receptical which may be thought of simply as a chamber is provided for attachment to existing pressurized dispensing containers such as pressurized sanitizing or pesticide control containers to provide a dual-compartmented easily separated composite container composed of a first chamber or dispensing tank adapted to contain a pressurized substance and another chamber for supplies exemplified by tools, poisons, concentrates, etc. mounted below the pressurized container and supporting it. The top of the supply chamber is sealed by the lower end of the tank and a releasable connecting or fastening means is operatively connected between the upper and lower chambers for releasably fastening them together. Thus, in use the technician is able to carry all supplies including his pressurized tank as a single unit to the job site and upon reaching the job site is able to disconnect and remove the sealed auxiliary container from the bottom of the pressurized tank to provide access to its contents when required.

DETAILED DESCRIPTION

Figure 1:
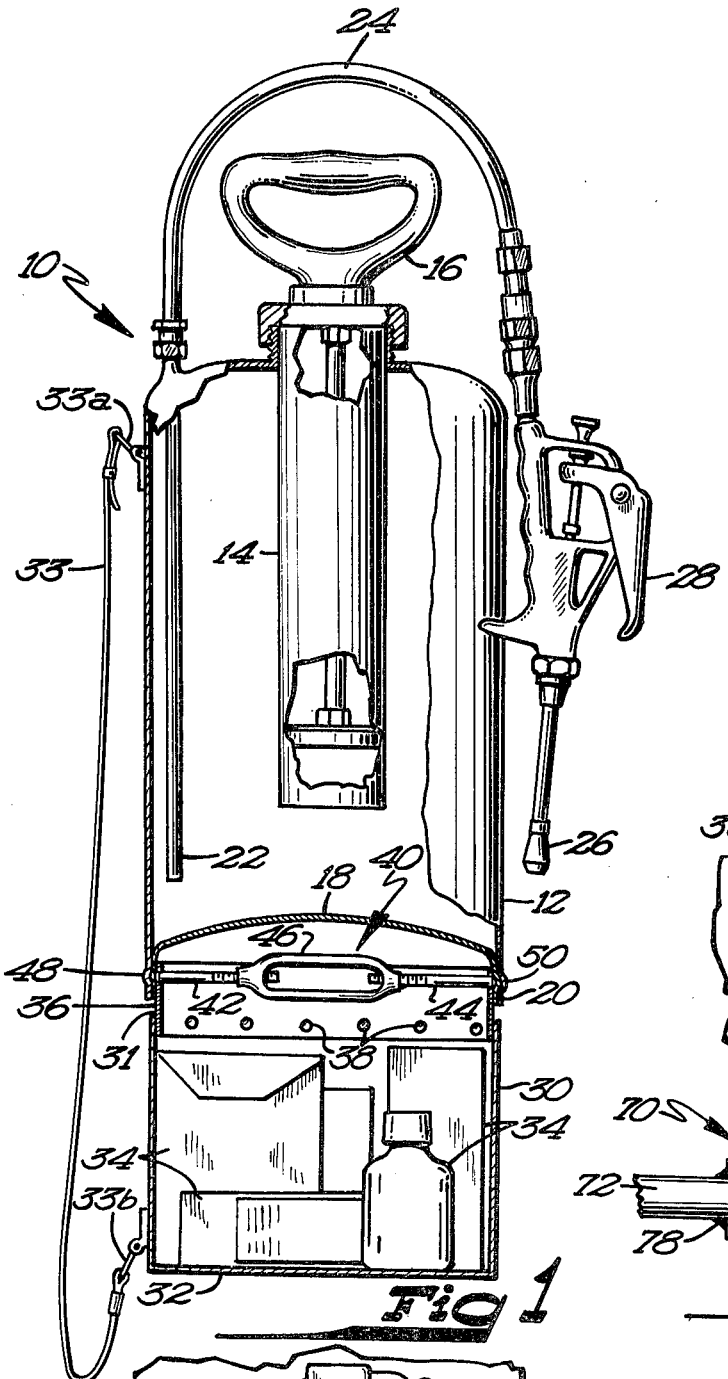
FIG. 1 is a partial vertical sectional view of a composite container embodying the invention.

Refer now to the figures particularly FIG. 1 in which is shown a composite container in accordance with the present invention indicated generally at 10. The composite container 10 includes an upper pressurized dispensing chamber or tank 12 which is generally cylindrical in shape in this case and in the form shown is commercially available from any of several manufacturers. The pressurized tank 12 includes the usual pressurizing pump 14 having a manually operated handle 16 allowing the tank 12 to be pumped up to the required pressure for expelling the contents through an outlet pipe 22 connected by means of flexible hose 24 to a spray nozzle 26 via control valve and handle 28. The tank 12 also includes a domed bottom 18 having a downwardly depending peripheral cylindrically shaped skirt 20 which is welded or otherwise bonded with a pressure proof seal to the adjacent bottom wall portion of the tank 12. The seal between the skirt 20 and the sidewall of tank 12 usually comprises an electric weld extending around the entire circumference of the tank to provide a completely pressure proof seal. During use, the tank is filled with the desired solution and pressurized by the operation of pump 14. The spray from nozzle 26 controlled by the operation of handle 28.

Releasably secured to the lower end of the tank 12 is an auxiliary supply container or chamber 30 which in this case is a cylindrical metal container of approximately the same diameter as tank 12. It includes an upper circular edge 31 a flat bottom wall 32 and contains a number of supplementary supplies indicated generally by boxes and bottles depicted at 34. Container 30 is aligned with i.e., coaxial with tank 12. The composite container is also provided with a shoulder strap secured at the top to tank 12 by means of a ring fastener 33*a* and to the container 30 by ring fastener 33*b*. The upper aspect of the auxiliary container 34 comprises a ring shaped collar or extension 36 which can be either integral with or permanently secured to the container 30 forming a part thereof as by means of spot welding 38 thereby defining an open circular mouth for the auxiliary container 30.

Figure 2:
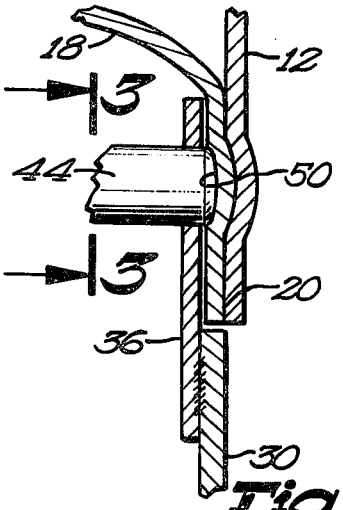
FIG. 2 is a greatly enlarged partial vertical sectional view of the composite container of FIG. 1 at the point of attachment between the upper and lower chambers.

Secured to the bottom edge of the tank 12 is a fastening bracket 40 comprising a turnbuckle as seen in FIGS. 1 and 2 formed from right and left handed threaded rods 42 and 44 and a turnbuckle connecting member 46 which when turned will drive the threaded rods 42 and 44 apart. The bracket 40 once mounted can remain in place indefinately and is incompressible lengthwise.

Before the fastening bracket 40 can be used, the bottom edge of the tank 12 is provided with two centrally facing diametrically opposed depressions or dimples 48 and 50, the one designated 50 being clearly shown in FIG. 2. The depressions 48 and 50 can be easily formed using a punch and die. It is important to note that by forming the recesses 48 and 50 in this manner, no boring or welding is required which could cause a leak in tank 12. Once the recesses 48, 50 are made, the fastening bracket 40 is placed in a position as shown in FIGS. 1 and 2 and the member 46 turned to press the free ends of the turnbuckle firmly into the opposed dimples in the skirt of the tank.

Figure 3:
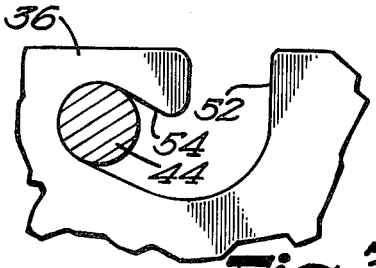
FIG. 3 is a partial sectional view taken on line 3—3 of FIG. 2.

The upper edge portion 36 of the auxiliary container 30 is provided with a pair of diametrically opposed notches 52 (one of which is shown in FIG. 3) each having circumferentially extending somewhat upwardly turned end portions 54 of the appropriate size to receive the ends 42 and 44 of the fastening bracket 40. It should be understood that the end portion of 54 at the right as seen in FIG. 1 extends away from the observer and the portion 54 of the notch 52 on the left of FIG. 1 which receives the threaded rod 42 extends toward the observer, i.e., both end portions extend counterclockwise. When the auxiliary container 30 is to be attached, it is raised so that each of the notches 52 engage the corresponding threaded rod section of the fastening bracket 40. It is then turned in a counterclockwise direction as seen from below thereby securely engaging the auxiliary container 30 at the lower end of the tank. When supplies 34 are to be removed from the container 30, it is twisted in the opposite direction and removed. In place on the lower end of tank 12, the auxiliary container is at all times sealed by the tank 12 which acts as a removable top or cover. The container 30 also serves as a supporting base for the tank when in place.

Figure 4:
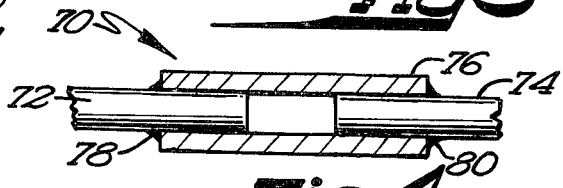
FIG. 4 is a partial vertical sectional view of a modified form of fastener employed for securing the chambers together.

Refer now to FIG. 4 which shows a modified form of fastening bracket in accordance with the invention. As shown in FIG. 4, the fastening bracket indicated generally at 70 comprises an unthreaded rod section 72 otherwise similar to rod 42 and a coaxial unthreaded rod section 74 which corresponds to threaded rod 44. Between the rod sections is a tube 76 within which the rod 72 and 74 are free to slide. When the fastening bracket 70 is to be used, the free ends (not shown) of the rods 72 and 74 are forced manually into the recesses 48 and 50 as in the case of the fastening bracket 40 already described. The rods are then rigidly secured to the tube 76 by means of welding or adhesive at 78 and 80 which serves as a means to hold the rod members in a selected position. As with the fastening bracket 40, the bracket 70 remains in place more or less permanently at the bottom of the tank. Auxiliary container 30 is mounted and removed as described above in connection with FIGS. 1, 2 and 3.

Figure 5:
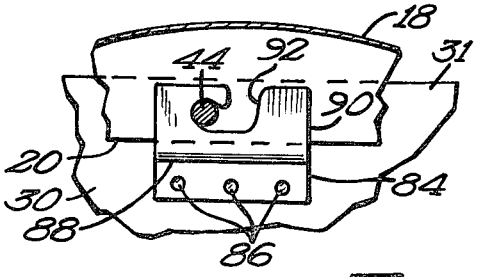
FIG. 5 is a partial vertical sectional view of an alternative motive for fastening upper and lower chambers together.

Refer now to FIG. 5 which illustrates still another means for connecting the tank 12 to the auxiliary container 30. As shown in FIG. 5 the auxiliary container 30 is cylindrical in shape and otherwise similar to that described in FIGS. 1–3 except that the collar 36 has been replaced by a pair of diametrically opposed generally vertically disposed flanges 84 only one of which is shown. Each flange 84 is fastened for example by means of spot welding at 86 to the upper edge of the container 30 and on the inward surface thereof. Each of the flanges 84 is formed from sheet metal and has a centrally extending bend which defines the lower end of an upwardly extending vertical portion 90 that is spaced a short distance inwardly, say about one-eighth" to one-fourth" inwardly from the upper edge 31 of the container 30. Each of the flanges 84 is provided with a notch 92 similar to the notches 52 already described to receive the ends of the fastening bracket 40, 62 or 70 mounted at the bottom of the tank 12. It will be seen in this case that the bottom edge or skirt portion 20 of the tank 12 telescopes within the upper edge 31 of the auxiliary container 30 and to this end the auxiliary container 30 is made with a slightly larger diameter than the lower end of tank 12. The flanges 84 fits interiorly of the lower edge 20 of tank 12 as shown in FIG. 5. The auxiliary container 30 is mounted at the lower edge of the tank and removed in the same manner as described in connection with FIGS. 1 through 3.

Figure 6:
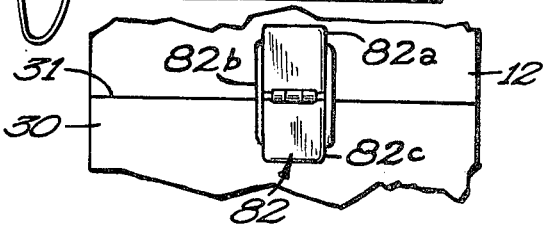
FIG. 6 is a partial side elevational view of another form of fastening means for securing upper and lower chambers together.

Refer now to FIG. 6 which illustrates still another form of the invention in which the auxiliary container 30 has the same diameter as the lower edge portion of the container 12. Thus, the upper edge 31 of the auxiliary container 30 abutts against the lower circular edge of the spray tank. The fastening bracket 40, 62 or 70 in this instance is not used. In its place is provided a plurality of circumferentially spaced apart commercially available trunk fasteners 82 of the kind used for fastening together edges of trunks and suitcases. While three or four fasteners are the most convenient number to use any number can be employed and it is preferred to fasten the top portion 82 either permanently to the lower edge of the tank 12 or by other means such as a metal band (not shown) extending circumferentially of the tank. When the auxiliary container 30 is to be secured to the lower end of the tank, the wire loop 82B extending upwardly from the lower portion 82C of each of the fasteners 82 is hooked over the top of 82A which is itself fastened in place on the tank 12 and the fastener snapped shut thereby securely holding container 30 in place at the lower end of the tank. The fasteners 82 are easily undone when the auxiliary container 30 is to be removed.

Figure 7:
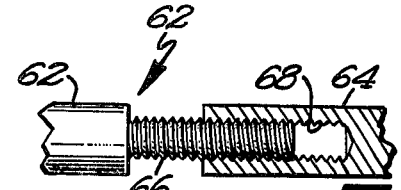
FIG. 7 is a modified form of connecting element or fastener for securing the upper and lower chambers together and, FIG. 8 is another modified form of connector for fastening the upper and lower chambers together.

Refer now to FIG. 7 which illustrates another form of fastening bracket in accordance with the invention. The fastening bracket 62 which corresponds to and is used in place of bracket 40 comprises a rod 62 having external threads 66 at one end and a rod 64 having internal threads 68 screwed onto threads 66. When the free ends of rods 62 and 64 are inserted into the recesses 48,50 in place of bracket 40, rod 62 is screwed outwardly thereby forcing the ends of the bracket into the recesses. The bracket 62 is used as described in connection with FIGS. 1 through 4.

In all cases, the auxiliary container is quickly and easily removed from the tank when required. The slots 52, 92 as well as the trunk fasteners 82 can be thought of as a releasable fastener means for securing auxiliary container to the lower aspect of the tank. It will be noted that in all cases the upper edge of the auxiliary container is positioned adjacent to and sealed by the tank 12 although its upper edge can telescope inside tank 12 as shown in FIG. 2, telescope outside tank 12 as shown in FIG. 5 or abutt thereagainst as shown in FIG. 6.

Figure 8:
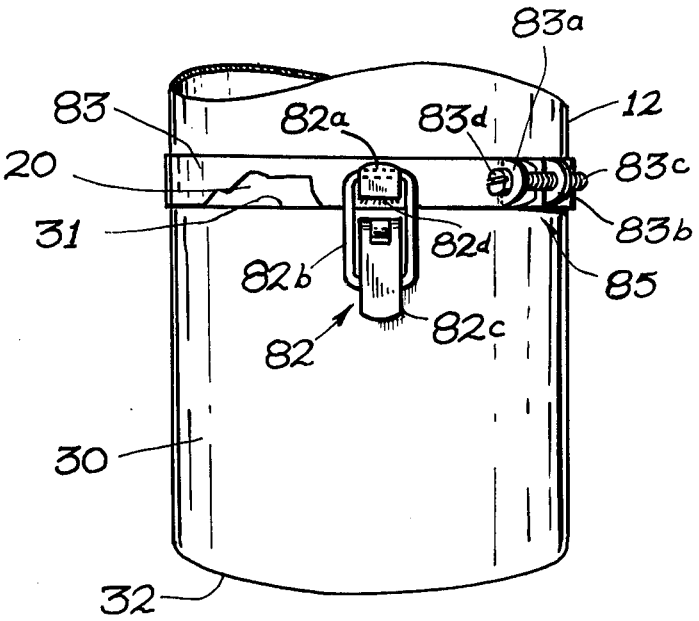

Refer now to FIG. 8 wherein the same numerals refer to parts already described. Releasably and removably secured to the skirt 20 at the bottom of tank 12 is an elongated fastening bracket which in this instance is a metal band 83 extending circumferentially of the tank 12 on the outside surface of skirt 20.

The bracket or band 83 is not secured to the tank by welding or by making perforations in the tank which, if present, could cause leakage. Instead, the band 83 like bracket 40 of FIG. 1 is releasably and removably connected to the skirt by threaded means. The threaded means comprises a screw **83*c* having a screw head 83*d*. The bank includes outwardly bent end pieces 83*a* and 83*b* both bored and the latter tapped for the threaded means to provide the releasable and removable connection with the skirt. Turning the screw 83*c* tightens or loosens the fastening bracket, i.e., the band 83** upon the lower end of the tank.

Commercially available trunk fasteners 82 are provided as in FIG. 6 which include a top portion **82*a* welded or otherwise fastened to the band 83 at 82*d*. Each trunk fastener 82 has a wire hook 82*b* that extends from the lower portion 82*c* of the trunk fastener 82 up over the top portion 82*a*. The bottom portion 82*c* is thrown downwardly to secure the auxiliary container 30 to the band 83 of the tank 12. Two trunk fasteners 82 which function as quick-disconnect releasable fastening means are usually used. Only one of them is shown in FIG. 8. In this way the quick-disconnect fastener 82 adjacent the open mouth 31 secures the auxiliary container 30 to the elongated fastening bracket comprising the band 83**.

It can be seen that the auxiliary container 30 is fastened to the bottom of the tank indirectly as described above by means of the intermediate elongated fastening bracket 83.

What is claimed is:

1. The combination of a pressurized dispensing tank for washing, sanitizing, exterminating pests, disinfecting and the like, and an indirectly connected auxiliary supply container at the bottom of the tank, said combination comprising:

(a) a pressurizable dispensing tank, (b) a pressurizing pump in the tank allowing the tank to be pumped to the required pressure for expelling contents therefrom through an outlet therein, (c) said tank including a circular skirt at the bottom thereof, (d) an elongated fastening bracket means releasably and removably secured to the circular skirt at the lower end of the tank, the bracket being thereby secured to the tank, (e) the fastening bracket including threaded means to provide the releasable and removable connection with the skirt at the lower end of the tank whereby turning the threaded means tightens or loosens the fastening bracket in place upon the lower end of the tank, (f) an auxiliary supply container comprising a container body having a sidewall, an open mouth at the top, a bottom wall and a quick-disconnect releasable fastening means adjacent the open mouth of the top thereof to secure the container to the elongated fastening bracket means, (g) whereby the auxiliary container is fastened to the bottom of the tank indirectly by means of the elongated fastening bracket secured there-between.

2. The combination of the pressurized dispensing tank for washing, sanitizing, exterminating pests, disinfecting and the like according to claim 1 wherein said elongated fastening bracket means comprises a metal band extending circumferentially of the lower edge of the tank and having said threaded means thereon to provide the releasable and removable connection with the skirt at the lower edge of the tank.

3. The combination of a pressurized dispensing tank for washing, sanitizing and exterminating pests, disinfecting and the like according to claim 2 wherein the metal band extending circumferentially of the lower edge of the tank includes threaded means whereby turning the threaded means tightens or loosens the fastening bracket upon the lower end of the tank.

4. The combination of a pressurized dispensing tank for washing, sanitizing, exterminating pests, disinfecting and the like according to claim 2 wherein a plurality of trunk fasteners are provided, each trunk fastener has a top portion and a bottom portion, the top portion of each trunk fastener is secured to the metal band, the bottom of each trunk fastener is connected to the auxiliary container, the upper edge of the auxiliary container is positioned adjacent to and sealed by the tank when the trunk fasteners are secured to the metal band, whereby the auxiliary container is fastened to the bottom of the tank indirectly by means of the circumferentially extending band secured there-between.

5. The combination of a pressurized dispensing tank for washing, sanitizing, exterminating pests, disinfecting and the like according to claim 2 wherein a plurality of quick-disconnect releasable fastening means are provided, each fastening means having a top portion and a bottom portion, the top portion of the quick-disconnect fastening means is secured to the band and the lower portion of each fastening means is connected to the auxiliary container with the upper edge of the auxiliary container positioned adjacent to and sealed by the tank mean, whereby the auxiliary container is fastened to the bottom of the tank indirectly by means of the band secured there-between.

* * * * *